US006950615B2

(12) United States Patent
Jung et al.

(10) Patent No.: US 6,950,615 B2
(45) Date of Patent: Sep. 27, 2005

(54) PROCEDURE AND DEVICE FOR ADJUSTING GLOSS IN PRINT MATERIAL

(75) Inventors: Eggert Joachim Jung, Schoenberg (DE); Wolfgang Eberhard Luxem, Kiel (DE); Holger Runkowske, Fahren (DE); Johann Weigert, Osdorf (DE); Thomas Zelenka, Moenkeberg (DE)

(73) Assignee: Eastman Kodak Company, Rochester, NY (US)

( * ) Notice: Subject to any disclaimer, the term of this patent is extended or adjusted under 35 U.S.C. 154(b) by 69 days.

(21) Appl. No.: 10/717,878

(22) Filed: Nov. 20, 2003

(65) Prior Publication Data

US 2005/0117929 A1 Jun. 2, 2005

(30) Foreign Application Priority Data

Dec. 11, 2002 (DE) ..... 102 57 715

(51) Int. Cl.[7] ..... G03G 15/20

(52) U.S. Cl. ..... 399/67; 399/325; 399/341; 399/390

(58) Field of Search ..... 347/104; 399/67, 399/328, 390

(56) References Cited

U.S. PATENT DOCUMENTS

| | | | | | |
|---|---|---|---|---|---|
| 5,325,164 | A | | 6/1994 | Tai et al. | |
| 6,091,924 | A | | 7/2000 | Bhattacharya | |
| 6,224,978 | B1 | * | 5/2001 | Chen et al. | 428/376 |
| 6,463,250 | B1 | * | 10/2002 | Chen et al. | 399/330 |
| 2002/0027587 | A1 | * | 3/2002 | Sugaya et al. | 347/104 |
| 2002/0197089 | A1 | * | 12/2002 | Satoh | 399/333 |
| 2002/0197483 | A1 | * | 12/2002 | Pickering et al. | 428/421 |

* cited by examiner

*Primary Examiner*—Arthur T. Grimley
*Assistant Examiner*—Peter Lee
(74) *Attorney, Agent, or Firm*—Lawrence P. Kessler

(57) ABSTRACT

To regulate the gloss on a print material, and avoid excess release oil, the properties of the fusing medium are measured, and the gloss on the print material is determined on the basis of the measured properties of the fusing medium.

7 Claims, 2 Drawing Sheets

PROCEDURE AND DEVICE FOR ADJUSTING GLOSS IN PRINT MATERIAL

FIELD OF THE INVENTION

The invention relates to adjusting gloss on print material taking into account, measured properties of a fusing machine.

BACKGROUND OF THE INVENTION

In the printing industry, printing materials are treated after printing in a fusing device, in which toner is fused onto the print material. For this, various processes are known in which energy is supplied to the toner so that it melts and is securely attached to the print material or carrier material. Typically, two heated rollers are used, one placed above, and the other below, the print material. These rollers fuse toner onto the print material by pressure and heat. A release oil, applied to the fusing roller, is used to facilitate removal of the print material from the upper roller or fusing roller. The release oil goes from the fusing roller onto the print material, and has a considerable effect on the gloss on the print material. In printing, gloss is a feature that determines the quality of the printing. Too much gloss is undesirable; with too much release oil on the print material leading to excess gloss in printing. Abrasion or wear of the fusing roller surface is a problem, which affects the transfer of release oil onto the print material and, as a result, unsuitable printings with undesired gloss occur.

SUMMARY OF THE INVENTION

An objective of the invention is to regulate the gloss on a print material. Another object of the invention is to avoid excess print gloss due to release oil.

This invention provides for adjusting the gloss of print material in a printing machine, in which a fusing medium fuses toner on a print material. Properties of the fusing medium are measured, and the gloss on the print material is determined based on the measured properties of the fusing medium. In a special embodiment, a replacing device changes the fusing medium. This makes possible automatic, rapid and simple replacement of the fusing medium.

It is advantageous to provide the surface of the fusing medium with a memory alloy, and due to such surface structure of the fusing medium is affected by changes in temperature. In this way, the gloss on the print material can be easily controlled. This obviates the need for replacing the fusing medium when undesired high gloss might occur as a result of a condition of the fusing medium. To facilitate removal of the fusing medium from the print material, the memory alloy is coated with a polymeric layer.

In one embodiment of the invention, the fusing medium has varied local structures, allowing for gloss areas of differing configuration on the fusing medium and on the print material. Different areas on the print material then exhibit varied degrees of gloss.

BRIEF DESCRIPTION OF THE DRAWINGS

Embodiments of the invention are described in detail using the following figures.

DETAILED DESCRIPTION OF THE INVENTION

Figure 1:
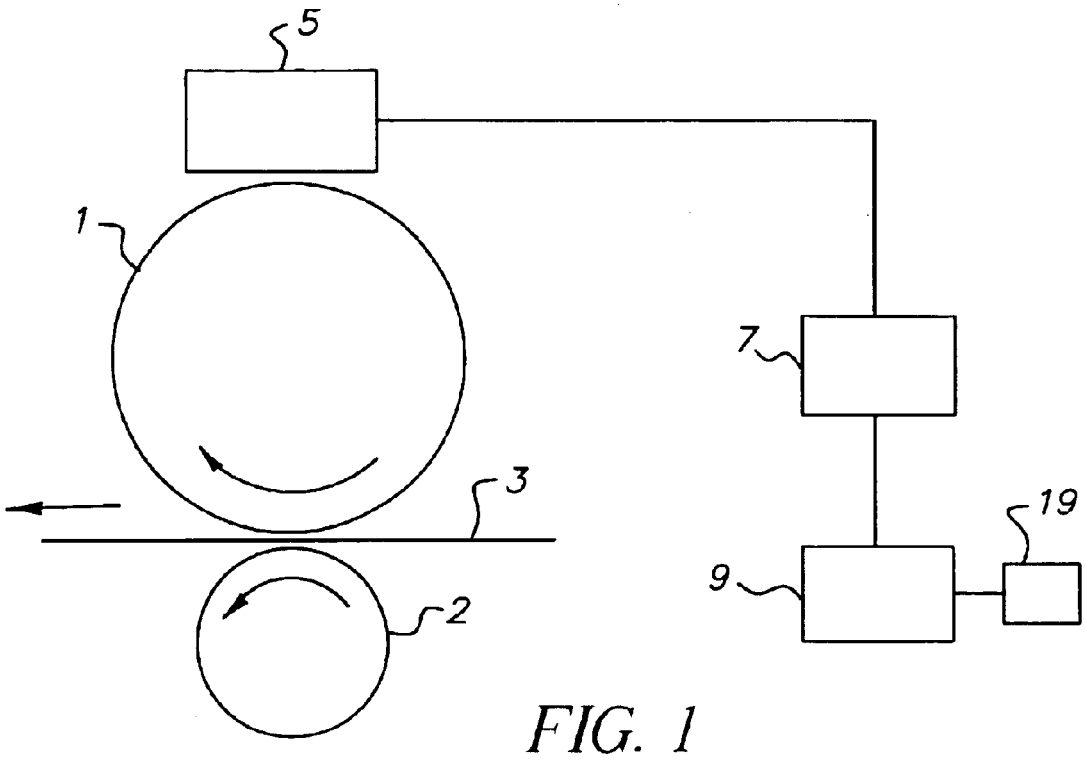
FIG. 1 is a schematic block-diagram of an embodiment of the invention with a measuring device and a computer.

FIG. 1 is a schematic lateral block-diagram view of a fusing medium 1 for fusing toner on print material 3, which is placed in a printing machine that is not depicted here. Fusing medium 1 is configured here as a fusing roller by way of example; fusing medium 1 may assume additional configurations. Fusing medium 1 is placed above print material 3 and compresses it with a certain force. Beneath print material 3, a counter-rotating pressure medium 2 is placed, which from below exerts a counterforce corresponding to the force of fusing medium 1, acting from above. The counter pressure medium 2 is configured here as a counter-pressure roller by way of example.

Fusing medium 1 and counterpressure medium 2 move in the directions shown by the curved arrows. Print material 3 is fed between fusing medium 1 and counterpressure roller 2 in the direction of the straight arrow. By action of heat and pressure from fusing medium 1 and counterpressure medium 2, toner is securely fused to print material 3. Behind fusing medium 1 and counterpressure medium 2, viewed in the direction of transport, toner is fixed to print material 3.

Adjacent to fusing medium 1 is a measuring device 5, which records the properties of fusing medium 1. For one, measuring device 5 records the surface roughness as a property of fusing medium 1, by determining the radius of fusing medium 1 at various locations on the surface of fusing medium 1 in the microscopic range. Measuring device 5 achieves this by having at least one sensor conduct distance measurements between the sensor and the surface of fusing medium 1. Surface roughness (i.e., changes in the ideal radius of fusing element 1) can be determined and recorded at various points on the surface of fusing medium 1 through distance measurements by measuring devices. For this, it is preferred that measuring device 5 records measures values at certain equal intervals from the surface of fusing medium 1. Equal intervals on fusing medium 1 are achieved through equal time intervals of the measured values. Additionally, a rotation sensor to determine the rotational angle of fusing medium 1 can be placed on fusing medium 1, which causes measuring device 5 to record measured values at equal intervals of rotational angles.

For another, measuring device 5 measures as a property the gloss on fusing medium 1, which is determined essentially by the quantity of oil on the surface of fusing medium 1. For this, measuring device 5 includes a reflectometer, for example. Measuring device 5 is connected to a computer 7, and transmits measured data from fusing medium 1 to computer 7, in which a calculation is made from the measured data recording the level gloss on the surface of fusing medium 1, and what surface roughness of fusing medium 1 results in what gloss on print material 3. It is basically true that the higher the gloss is on fusing medium 1, the higher will be the gloss on print material 3, on which fusing medium 1 exerts a force, in the event that the fusing roller makes rolling contact according to FIG. 1 on print material 3. With greater fusing medium of the surface roughness of 1, the less fusing oil is transferred from fusing medium 1 to print material 3, and less gloss appears on print material 3.

The gloss on print material 3 is determined, for example, as follows. In test runs, the gloss produced on print material 3 is recorded in terms of dependence on the gloss and surface roughness on fusing medium 1. Each gloss value on print material 3 is assigned a gloss value on fusing medium 1 and a surface roughness value on fusing medium 1. From these data, functional mathematical connections are developed and stored in computer 7. As a consequence, mathematical interrelations are available between the properties, surface roughness, and gloss, of fusing medium 1 and the gloss of print material 3. In an unambiguous manner, a value of the gloss of print material 3 is assigned to each value of the property of fusing medium 1. As a result, a device is prepared to determine the gloss on print material 3 by a computational process in computer 7 during the printing process, in that the gloss on the surface and the surface roughness of fusing medium 1 are determined.

Computer 7 is connected with a control device 9 for the print machine, and transmits the results of the gloss determined during the printing process to it, as described above. Control device 9 for the printing machine includes a display device 19, to which the results are transmitted, and which are available to an operator of the printing machine. Using the output to display device 9, the operator may decide whether fusing medium 1 is still suitable for the printing process or whether, based on wear or abrasion on its surface, it must be replaced.

Figure 2:
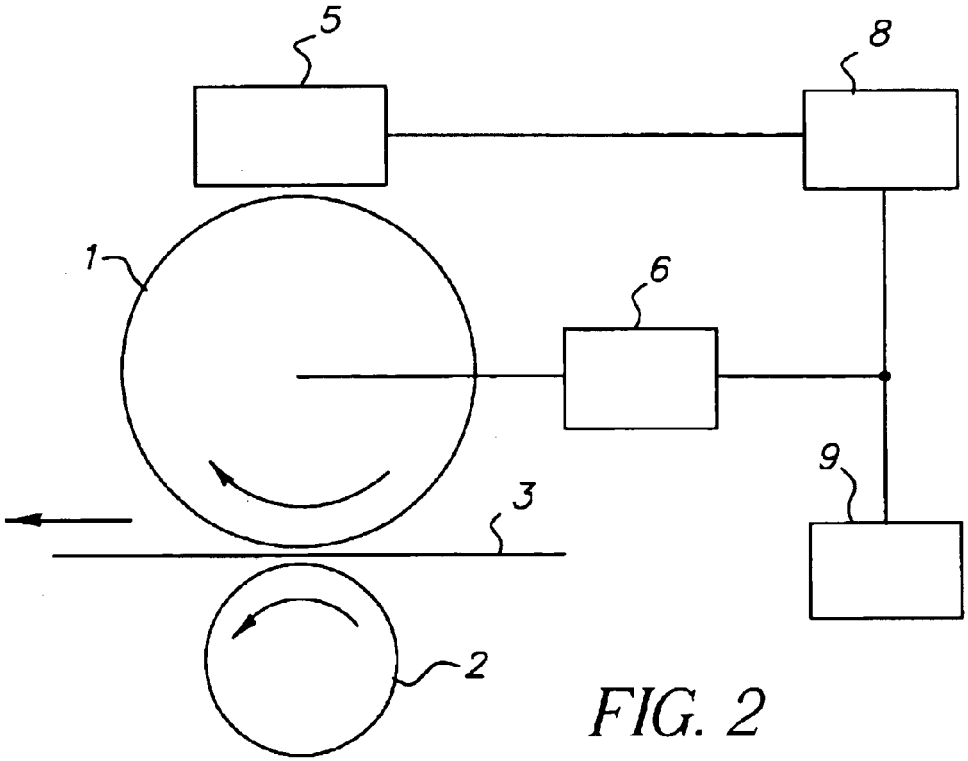
FIG. 2 is a schematic block-diagram of an additional embodiment of the invention with a measuring device, a database, and a device for replacing; the fusing medium, as well as controls for a printing machine.

FIG. 2 is a schematic block-diagram of an additional embodiment of the invention with a measuring device 5 similar to FIG. 1. Measurement data regarding the surface roughness and gloss of fusing medium 1 are transmitted from measuring device 5 to database 8. In database 8, data that was obtained in test runs regarding the surface roughness and gloss of fusing medium 1, is stored and compared with measurement data during the printing process. If the measured data varies by a specific value from the data in database 8, it can be deduced that fusing medium 1 for fusing toner on print material 3 is no longer suitable.

The properties of fusing medium 1, varies with the number of printings. Therefore, these values are re-measured at stipulated time intervals and stored in database 8. Therefore, database 8 is always appropriately up-to-date. In this case, the measured properties of fusing medium 1 may result in unwanted gloss on print material 3. Based on a comparison of measured data with data stored in database 8, a decision is made whether to continue using fusing medium 1, or replace it. If the comparison in database 8 yields a result in which, together with the measured gloss and surface roughness, unwanted gloss appears on print material 3, then a signal is transmitted to a replacing device 6 to replace fusing medium 1, which triggers the changing of fusing medium 1. Fusing medium 1 is swiveled away from print material 1 and is replaced by another fusing medium. Original fusing medium 1 is then removed from the printing machine and administered maintenance or replaced.

Additionally, stored in database 8 are data regarding various types of print materials used by the printing machine and the gloss produced on their surfaces at various gloss and surface roughness on fusing medium 1 are stored in database 8. The various print material types exhibit various surface densities as well as various surfaces. In this embodiment, control device 9 for the print machine transmits information regarding the type of print material selected for a particular print order to database 8. Based on information regarding the type of print material, measurement values of measuring device 5 in database 8 are each compared with the data for the selected type of print material. In this way, a print material dependent adjustment of the gloss of print material 3 becomes possible, which is advantageous with changing types of print material. In this regard, the fact that various types of print material consumes varied quantities of fusing oil is permitted and, despite the fact that quantities of fusing oil remain the same, various types of print materials exhibit differing gloss. Additionally, sometimes varied gloss effects are desired with different print orders. For example, high-gloss printings appear more color-intensive and exhibit a higher color depth than printings with the usual gloss. If altered gloss is desired, or if a greater or reduced gloss on print material is desired, then control device 9 of the print machine exerts control of replacement device 6 for replacing fusing medium 1, so that a fusing medium 1 can be swiveled onto print material 3 which exhibits those properties that result in the desired gloss on print material 3. For this, a selection of fusing media 1 are available for controlled swiveling onto or off print material 3. In this way, through the selection of fusing medium 1, the desired gloss of the print on print material 3 can be selected, depending on the type of print material.

Figure 3:
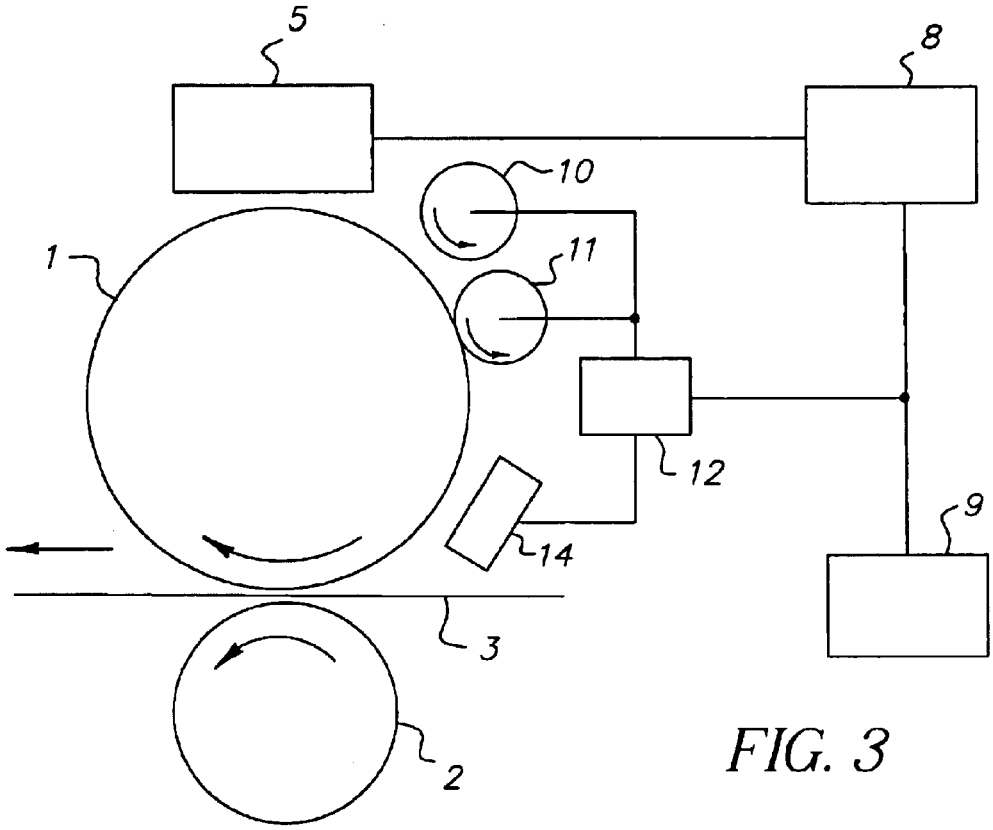
FIG. 3 is a schematic block-diagram of an additional embodiment of the invention with a fusing medium with a memory alloy, imprinting rollers, smoothing rollers and a heating device, a measuring device and a database, as well as controls for a printing machine.

FIG. 3 is a schematic block-diagram of a fusing medium 1 from a particular embodiment of the invention. The surface of fusing medium 1 includes a so-called memory alloy, also called a shape memory alloy. Depending on the temperature affecting it, the memory alloy exhibits two different crystal structures. With one temperature change, the crystal structure and the form of the memory alloy is changed. With the first temperature, the surface of fusing medium 1 is made smooth. With the second temperature, usually a lower one, the surface of fusing medium 1 is provided with a structure, for example by an imprinting roller 10. As an alternative, magnetic memory alloys can be created, in which their surfaces are restructured by application of a magnetic field. These will not be considered further.

In FIG. 3, imprinting roller 10 is depicted as being swiveled away from fusing medium 1. Further imprinting rollers 10 can be provided, which apply various imprints to fusing medium 1. For imprinting on the memory alloy, imprinting roller 10 is applied to fusing roller 1 and makes rolling contact with it, with the structured configuration of the surface of imprinting roller 10 being transferred as a negative onto fusing medium 1. A control device 12 is provided to swivel impinging rollers 10 on and off, when fusing medium 1 is to be imprinted with a memory alloy. Additionally, control device 12 governs a heating device 14, which is placed in proximity to fusing medium 1. Heating device 14 includes, for example, a laser, a microwave, or heating lamp and, governed by control device 12, heats the surface of fusing medium 1. In the imprinting process in which, the surface of fusing medium 1, is imprinted by imprinting roller 10, a low temperature exists on the memory alloy; heating device 14 is switched off. If, as described earlier, a determination is made that the surface of fusing medium 1 is unsuitable due to abrasion or wear in the fusing process, heating device 14 is directed by control device 12, and heats the memory alloy of fusing medium 1 to a higher temperature. Due to heating, the memory alloy assumes a different crystal structure, and the memory alloy gets a smooth imprint. The memory alloy now assumes the form, which it exhibits before imprinting, by imprinting roller 10, in this case, the smooth state. Thereafter, heating device 14 is switched off; through the resulting cooling on the memory alloy, it now assumes the state that it exhibits after imprinting, by imprinting roller 10. The surface structure of fusing medium 1 is recreated and, despite abrasion or wear, fusing medium 1 is again able to be used further by the printing process.

In an embodiment of the invention, two imprinting rollers 10 are used, which make possible a varied imprint structure of the memory alloy. If another structure of the memory alloy and a different gloss are desired on print material 3, after smoothing by the second print roller, which exhibits a structure different from imprinting roller 10, the memory alloy is again imprinted. It is not necessary to replace fusing medium 1. Between the imprinted state and the smooth state, with the aid of the memory alloy, further intermediate states of fusing medium 1's surface structure can be created. Due to a deliberate heating, the height of the structure on the surface of fusing medium 1 can be adjusted, and a partial smoothing, or creation of height differences, is possible. The height of the structure of the memory alloy from the imprinted state, starting with the extreme height, can be adjusted through alterations in temperature by heating device 14. A controlled temperature on heating device 14 corresponds to a height of structure on the memory alloy.

By this arrangement, due to altered takeup of fusing oil by fusing medium 1, at varied structural heights on the memory alloy, the gloss on print material 3 can be adjusted. Database 8 obtains from print machine 9 data regarding the type of print material currently used in the print order, and the desired gloss on the print material 3 used. The previous data are assigned in database 8 to a value which determines the heating of heating element 14, so that the memory alloy is heated in relation to the type of print material and the desired gloss on print material 3. The value assigned in database 8 is transmitted to control device 12, and appropriately exerts control on heating device 14, which determines the structure height of the memory alloy.

The heating of heating device 14 can be transmitted in locally limited fashion to fusing medium 1, with locally limited areas of fusing medium 1 being smoothed, while other areas are elevated. This ultimately results in various places on the image area on print material 3 being provided with differing gloss. In fusing with fusing medium 1 on print material 3, areas on fusing medium 1 with differing structure follow each other, so that for example a sheet of print material 3 comes into contact with several areas, and correspondingly several areas on the sheet of print material 3 are formed with varied gloss. For example, use of a laser in heating device 14 can cause the structure of the memory alloy to be locally adjusted, with the gloss on print material 3 capable of being locally altered, so that the gloss at various locations on print material 3 is different.

To facilitate the smoothing process for the smoothing of the surface of fusing medium 1, a smoothing roller 11 may be provided for fusing medium 1. The smoothing roller 11, is governed by control device 12, and swivels smoothing roller 11 onto fusing medium 1, so that smoothing roller 10 makes rolling contact with fusing medium 1. When smoothing roller 11 makes rolling contact, the memory alloy on the surface of fusing medium 1 is smoothed in addition to the effect described previously. However, smoothing roller 11 is not a necessary component.

Figure 4A:
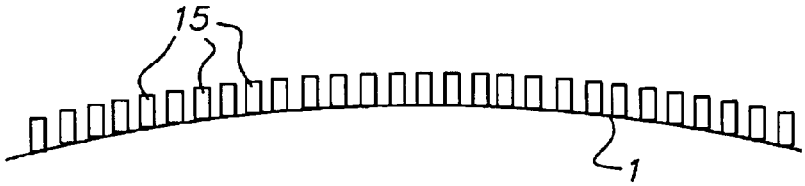
FIG. 4*a* schematically shows a section of a surface of a fusing medium with a memory alloy at a certain temperature with a rough structure.
Figure 4B:
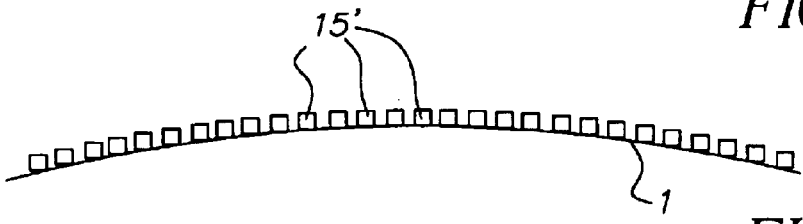
FIG. 4*b* schematically shows a section of a surface of a fusing medium with a memory alloy at a higher temperature with a less rough structure.

FIG. 4*a* clarifies the description above by showing a schematic section of a fusing medium 1 with a memory alloy that exhibits a markedly printed structure, depicted in exaggerated form for the sake of clarification. At a low temperature, the rolling contact of imprinting roller 10 with fusing medium 1 results in a coarse structure on fusing medium 1, which takes up a large quantity of fusing oil and passes it to print material 3. The structure on the surface is depicted in FIGS. 4*a* and 4*b* only for clarification respectively with projections 15, 15'. The projections 15, which represent the surface structure of fusing medium 1, in FIG. 4*a* reveal a great height after imprinting of fusing medium 1 by imprinting roller 10, and the surface structure of fusing medium 1 is strongly imprinted. Fusing medium 1 with the FIG. 4*a* surface structure is configured for the fusing of toner to create a certain gloss with a certain type of print material.

FIG. 4*b* is a schematic cross section of fusing medium 1, in which the structure on fusing medium 1 is flatter than according to FIG. 4*a*. For clarification, the projections 15' have a smaller height than the projections 15 according to FIG. 4*a*. The way in which this surface structure as per FIG. 4*b* is attained is that heating device 14 reaches a higher temperature and transmits this to fusing medium 1. In this case, fusing medium 1 exhibits a different roughness and gloss from that according to FIG. 4*a*, and the takeup of fusing oil and transmission of fusing oil to print material 3 is lessened. Fusing medium 1, with the surface structure according to FIG. 4*b*, is configured for the fusing of toner to attain a different gloss with the same type of print material as according to FIG. 4*a*, or to attain an equal gloss with a different type of print material than according to FIG. 4*a*. Additionally, the flatter structure of the memory alloy of fusing medium 1 appeared after a certain period when fusing medium 1 was in operation, with the projections 15' becoming smaller than projections 15 in FIG. 4*a* through abrasion or wear; and the memory alloy on the surface of fusing medium 1, as a reaction to this, is controlled by heating device 14. The temperature is raised, whereupon the surface of fusing medium 1 is made smooth; the temperature is thereupon lowered and the memory alloy again assumes its original structure as, for example, according to FIG. 4*a*.

The surfaces according to FIGS. 4*a* and 4*b* may represent varied cross-sections on a single fusing medium 1. This is attained by having heating device 14 heat various sections of fusing medium 1 inhomogeneously, and the variously heated sections obtain different structures. In this case, various parts of print material 3 are touched by variously structured sections of fusing medium 1, and correspondingly produce varied gloss. For example, one half of a sheet of print material 3 is printed with an image that, through the fusion of fusing medium 1 in this way with a particular structure, obtains a certain gloss, while the other half of the sheet has text printed on it and, through fusion with a section differently structured of fusing medium 1, obtains a different gloss.

Figure 4C:
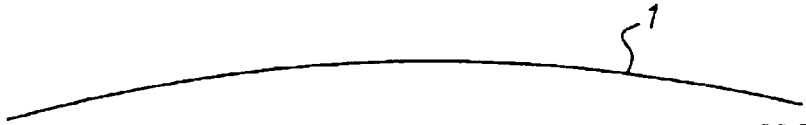
FIG. 4*c* schematically shows a section of the surface of a fusing medium with a memory alloy at a still higher temperature with a smooth structure.

FIG. 4*c* shows schematically a section of fusing medium 1 with a smooth surface of the memory alloy of fusing medium 1. The temperature of heating device 14 is higher than in FIGS. 4*a* and 4*b*,and the uptake and transmittal of fusing oil is much curtailed. With a lowering of the temperature by exerting control on heating device 14, the memory alloy assumes the structure according to FIG. 4*a*,and fusing medium 1 can continue to be used for fusing. By using the memory alloy, we can avoid a repetition of the imprinting of fusing medium 1 by the imprinting roller 10 where the imprinted surface is abraded or worn. A description is provided above of how the memory alloy is smoothed at high temperatures, while it forms its elevated structure at low temperatures. By use of another appropriate memory alloy, this interrelation is reversible, so that the raised structures are formed at high temperatures, and smoothing takes place at low temperatures.

The invention has been described in detail with particular reference to certain preferred embodiments thereof, but it will be understood that variations and modifications can be effected within the spirit and scope of the invention.

What is claimed is:

1. Procedure for adjusting the gloss on a print material (3) in a printing machine where a fusing medium (1) provided with a memory alloy fuses toner on print material (3), the procedure comprising the steps of: measuring properties of the fusing medium (1), determining the gloss on print material (3) on the basis of the measured properties of fusing medium (1), and heating the fusing medium (1) locally differentially thereby configuring the surface structure of the fusing medium (1) to influence the memory alloy by temperature changes so as to vary gloss areas attained by the memory alloy on the print material (3).

2. Procedure for adjusting the gloss on a print material (3) according to claim 1, wherein, based on the measurement of properties of the fusing medium (1), the fusing medium (1) is replaced if necessary.

3. Procedure for adjusting the gloss on a print material (3) according to claim 1, further coating the memory alloy with a polymer layer.

4. Device for adjusting the gloss on a print material (3), comprising: a fusing medium (1) including a memory alloy, an imprinting roller (10), said imprinting roller being selectively swiveled onto and away from said fusing medium (1), a heating device (14) associated with said memory alloy of said fusing medium (1) to change the surface structure of said memory alloy, a measuring device (5) for measuring the properties of said memory alloy of said fusing medium (1), a computer (7), associated with said measuring device (5) for determining the gloss on print material (3) on the basis of data from said measuring device (5).

5. Device according to claim 4, wherein said computer (7) includes a database (8) to store data on the properties of fusing medium (1).

6. Device according to claim 4, further including a smoothing roller (11) selectively swiveled on to and away from said fusing medium (1) for smoothing said memory alloy of said fusing medium (1).

7. Device according to claim 4, wherein said heating device (14) includes a control for differentially heating said fusing medium (1) thereby selectively configuring the surface structure of said fusing medium (1) to influence said memory alloy by temperature changes so as to vary gloss areas attained by said memory alloy on print material (3).

* * * * *